US006773013B2

(12) United States Patent
Caldwell

(10) Patent No.: US 6,773,013 B2
(45) Date of Patent: Aug. 10, 2004

(54) ENHANCED TWENTY-ONE CARD GAME

(76) Inventor: Adrian Caldwell, 319 Concord Dr., Clinton, MS (US) 39056

( * ) Notice: Subject to any disclaimer, the term of this patent is extended or adjusted under 35 U.S.C. 154(b) by 0 days.

(21) Appl. No.: 10/702,309

(22) Filed: Nov. 6, 2003

(65) Prior Publication Data

US 2004/0090008 A1 May 13, 2004

Related U.S. Application Data

(60) Provisional application No. 60/425,116, filed on Nov. 7, 2002.

(51) Int. Cl.[7] ..... A63F 1/00

(52) U.S. Cl. ..... 273/292; 273/274; 273/309

(58) Field of Search ..... 273/292, 274, 273/309

(56) References Cited

U.S. PATENT DOCUMENTS

| | | | | | |
|---|---|---|---|---|---|
| 5,174,579 | A | * | 12/1992 | Griffiths | 273/292 |
| 5,248,142 | A | * | 9/1993 | Breeding | 273/138.1 |
| 5,257,810 | A | * | 11/1993 | Schorr et al. | 273/292 |
| 5,275,416 | A | * | 1/1994 | Schorr et al. | 273/292 |
| 5,280,915 | A | * | 1/1994 | Groussman | 273/292 |
| 5,377,993 | A | | 1/1995 | Josephs | |
| 5,390,934 | A | * | 2/1995 | Grassa | 273/292 |
| 5,395,119 | A | * | 3/1995 | Jacob et al. | 273/274 |
| 5,454,570 | A | * | 10/1995 | Karal | 273/292 |
| 5,494,296 | A | * | 2/1996 | Grassa | 273/292 |
| 5,632,485 | A | | 5/1997 | Woodland et al. | |
| 5,707,285 | A | | 1/1998 | Place et al. | |
| 5,713,574 | A | | 2/1998 | Hughes | |
| 5,836,586 | A | * | 11/1998 | Marks et al. | 273/292 |
| 5,984,308 | A | * | 11/1999 | Herrmann | 273/292 |
| 6,012,719 | A | | 1/2000 | Webb | |
| 6,062,564 | A | * | 5/2000 | Terminel | 273/292 |
| 6,070,875 | A | | 6/2000 | Boylan et al. | |
| 6,079,712 | A | | 6/2000 | Eaton et al. | |
| 6,095,525 | A | | 8/2000 | Terminel | |
| 6,113,102 | A | * | 9/2000 | Marks et al. | 273/292 |
| 6,158,741 | A | * | 12/2000 | Koelling | 273/292 |
| 6,179,292 | B1 | | 1/2001 | Aramapakul | |
| 6,182,969 | B1 | * | 2/2001 | Green | 273/292 |
| 6,227,969 | B1 | * | 5/2001 | Yoseloff | 463/13 |
| 6,279,910 | B1 | * | 8/2001 | de Keller | 273/292 |

(List continued on next page.)

*Primary Examiner*—Derris H. Banks
*Assistant Examiner*—Dolores R. Collins
(74) *Attorney, Agent, or Firm*—Thorpe, North & Western, LLP

(57) ABSTRACT

A method for enhancing a conventional game of Twenty-one includes the steps of providing a player an opportunity to place a Twenty-one wager to participate in the conventional game of Twenty-one; providing the player an opportunity to place a match wager that an index value of at least one of an initial two cards dealt to the player will match an index value of a face-up card dealt to a dealer; dealing the initial two cards to the player and dealing the face-up card to the dealer; verifying that the player placed the match wager and paying the player a match winning amount on the match wager if the index value of at least one of the initial two cards dealt to the player matches the index value of the face-up card; and continuing with play of the conventional game of Twenty-one. The method can include the further steps of: providing the player an opportunity to place a poker wager that a two-card poker hand value of the initial two cards dealt to the player will equal one of a plurality of paying two-card poker hand values; and verifying that the player placed the poker wager and paying the player a poker winning amount if the two-card poker hand value of the initial two cards dealt to the player equals one of the plurality of paying two-card poker hand values.

20 Claims, 6 Drawing Sheets

U.S. PATENT DOCUMENTS 6,293,551 B1 9/2001 Webb
6,302,396 B1 10/2001 Eaton et al.
6,341,778 B1 * 1/2002 Lee ..... 273/292
6,375,190 B1 * 4/2002 Kocher ..... 273/303
6,386,973 B1 * 5/2002 Yoseloff ..... 463/13
6,390,474 B1 * 5/2002 Terminel et al. ..... 273/292
6,394,456 B1 * 5/2002 Long ..... 273/292
6,523,831 B2 2/2003 Webb
6,604,741 B1 * 8/2003 Snow ..... 273/292
6,659,461 B2 * 12/2003 Yoseloff et al. ..... 273/274
2002/0074726 A1 * 6/2002 Yoseloff et al. ..... 273/274
2002/0195773 A1 * 12/2002 Dunn ..... 273/274
2003/0003989 A1 * 1/2003 Johnson ..... 463/25
2004/0023712 A1 * 2/2004 Oliver ..... 463/18

* cited by examiner

Match Payout Schedule:

| | |
|---|---|
| 6 Deck | |
| 1 Match Unsuited | 4 to 1 |
| 1 Match Suited | 10 to 1 |
| 2 Matches (any) | 15 to 1 |
| 2 Deck | |
| 1 Match Unsuited | 4 to 1 |
| 1 Match Suited | 10 to 1 |
| 2 Matches (any) | 20 to 1 |

20a

FIG. 2A

2-Card Poker Payout Schedule:

| | |
|---|---|
| 6 Deck | |
| Straight | 3 to 1 |
| Pair | 3 to 1 |
| Straight Flush | 4 to 1 |
| 2 Deck | |
| Straight | 3 to 1 |
| Pair | 3 to 1 |
| Straight Flush | 4 to 1 |

20b

FIG. 2B

ENHANCED TWENTY-ONE CARD GAME

This application claims benefit of U.S. Provisional Application No. 60/425,116, filed Nov. 7, 2002, which is hereby incorporated herein by reference.

BACKGROUND OF THE INVENTION

1. Field of the Invention

The present invention relates generally to a method for playing an enhanced game of Twenty-one, or Blackjack. More particularly, the present invention relates to a game of Twenty-one or Blackjack that provides optional side wagers to enhance a player's interest in the game.

2. Related Art

The conventional game of "Twenty-one," or Blackjack is a popular card game of chance which has been played in gaming establishments throughout the world for a number of years. In a typical Blackjack game, each player places his or her initial wager, also known as his "ante," before any cards are dealt. The wager can generally be any amount the player wishes to gamble, subject generally to a minimum and maximum table limit established by the gaming establishment, or casino. Each player is then dealt two cards, both of which are generally dealt either face down, i.e., with the "face" of the card placed down, so that only the player can see the value of the player's hand, or face-up, depending on the game rules governing play. The dealer is dealt two cards, one of which is commonly face down and one of which is commonly face up. Each player, in turn, then takes as many "hits" (additional cards) as he or she elects until he or she either "stands" (stops with hand count less than or equal to twenty-one) or "busts" (hand count exceeds twenty-one). Each player may stand with any hand count of twenty-one or less. If a player busts, the player loses his or her wager, regardless of whether or not the dealer later busts his or her "house" hand.

After each of the players, in turn, has taken as many hits as each elects and has stood on his or her hand or busted, the dealer then turns over his or her face down card and then either stands on his or her hand or takes hits in accordance with the house rules. Most often, the house rules require that the dealer stand on his or her hand if the dealer hand has a count of seventeen or more, and require that he or she take hits if the dealer hand count is sixteen or less, until he or she attains a hand count of seventeen or more. After obtaining a hand count of seventeen or more, the dealer is typically not allowed to take additional hits, unless one of his or her cards is an ace.

In most establishments, the house rules require that the dealer take a hit if his initial hand is an ace and a six ("soft" seventeen), or if, after receiving one or more hits, the dealer's hand consists of an ace and two or more cards that add up to a card count of six. Also under the conventional manner of play, the dealer is required to stand if his initial hand is a soft eighteen, soft nineteen or soft twenty, and the ace is then counted with a card count of eleven. If the dealer busts, each player who has not busted wins. If the dealer does not bust, then the hand count for each player is compared with the hand count of the dealer. If the hand count of a player exceeds that of the dealer, the player wins—he or she is generally paid on a 1:1 basis. If the hand count of the dealer exceeds that of the player, the player loses. If the player's hand count ties that of the dealer, it is called a "push" and the rules of play used by the gaming establishment may provide that the player loses his wager or that the player's wager is returned to him.

The conventional method of playing Twenty-one which is utilized by most gaming establishments also includes at least three well-known procedures. These are "insurance," "doubling down" and "splitting pairs."

After each player and the dealer receives their first two cards, if the dealer's "up" card is an ace, each player may elect to make an "insurance" bet. The amount of the insurance bet, for each player making the election, is most often limited to one-half of the amount of his original ante. Then the dealer, without turning over his face-down card, checks the face-down card, and if the dealer has a Blackjack (a two card, twenty-one count hand), he or she then turns over the face-down card. Each player placing an insurance bet wins and is generally paid on a 2-to-1 basis for the insurance bet only. All players who do not also have a two-card, twenty-one count hand (a Blackjack), lose his or her original ante regardless of his or her insurance bet. Each player also having a two-card twenty-one count hand has his or her ante returned to the player or loses his ante, depending on the house rules.

Another well known procedure utilized by gaming establishments is "doubling down." The initial two-card, hand counts total which permit a player to elect to "double down" is established by house rules. While many casinos allow a player to double down on any two cards, three common double down hand counts utilized by gaming establishments are (a) nine, ten, or eleven; (b) ten or eleven; or (c) eleven only. If the player has an initial two-card hand count total equal to one of the values established by the house rules, he or she may elect to double down. The player informs the dealer of the player's election to double down and places an additional wager up to the amount of his or her original ante. The dealer then deals to that player one and only one additional card, face-down, and the resulting three-card hand establishes the final count for that player's hand. The player's three card hand count is compared with the dealer's final hand count and the amount of the player's wager is the total of the original ante and the double down bet.

Another well known procedure utilized by gaming establishments is "splitting pairs." For example, if the first two cards of a player's hand are a pair, or are both ten-count cards, that player may elect to "split" the initial two cards into two separate hands. The player then applies his original ante to one of the two hands and places an additional ante for the other hand. Both of the original two cards are then turned face-up and the player plays each of the two hands as a separate hand in accordance with the house rules. Some gaming establishments only allow splitting if the player's first two cards are a true pair. House rules also may allow a player to double down on either or both hands.

With the exception of the above-described doubling, splitting and insurance bets, a Twenty-one player is generally limited to wagering only an initial ante, and the return or loss of his or her ante is determined by the resulting cards dealt. Often, however, players may wish to add some variety to the standard game of Blackjack. For this reason, variations on the standard Blackjack game have been introduced by some gaming establishments. These variations have taken several forms, some of which have proved overly complicated for many players to understand, leading to disfavor of the variations by players. Other variations result in such low-paying returns that players eventually stop wagering on the variations. Other attempts to add variation to the Blackjack game result in so much variation that the underlying game of Blackjack gets lost in the variation, turning away many devoted Blackjack players.

One of the types of variations that has met with some success is the offering of "side bets," which allow a player to place a wager on an outcome only indirectly associated with the outcome of the Blackjack deal. One such variation, known as "Royal Match," allows a player to place a "side" wager, or a wager in addition to the player's ante, that is won if the player's first two cards are matched in suit. Winning with a matched-suit pair of first two cards often pays the player 3:1 on his side wager. If the player's first two cards are the King and Queen of a matched suit, the player can win a higher payoff, on the order of 10:1, depending on the house rules of each casino.

While such variations have proved popular for at least a period of time, players continue to express interest in further varieties of side bets to add more excitement to the game of Blackjack. Casino owners and operators are interested in meeting this demand to keep players at the tables. However, casino owners have to date been limited in the varieties they can offer players, as the casino must thread a fine line between overcomplicating and/or altering the game, while adding variations that players appreciate and are willing to pay to play. Also, casino owners are interested in adding variety to the game of Blackjack in a manner that maintains the relatively fast pace of the game, as generally speaking, more hands played results in more revenue for the casino.

SUMMARY OF THE INVENTION

It has been recognized that it would be advantageous to develop a relatively easily understood and player friendly side wager option to enhance the attraction of a conventional Twenty-one game. It has also been recognized that it would be advantageous to develop an enhanced game of Twenty-one that pays winnings to players sufficiently frequently to render the enhanced game attractive to players while increasing an over-all revenue intake of a gaming establishment.

The invention provides a method for enhancing a conventional game of Twenty-one, and can include the steps of: providing a player an opportunity to place a Twenty-one wager to participate in the conventional game of Twenty-one; providing the player an opportunity to place a match wager that an index value of at least one of an initial two cards dealt to the player will match an index value of a face-up card dealt to a dealer; dealing the initial two cards to the player; verifying that the player placed the match wager and paying the player a match winning amount on the match wager if the index value of at least one of the initial two cards dealt to the player matches the index value of the face-up card; and continuing with play of the conventional game of Twenty-one.

In accordance with a more detailed aspect of the present invention, a method for enhancing a conventional game of Twenty-one is provided, and can include the steps of: providing a player an opportunity to place a Twenty-one wager to participate in the conventional game of Twenty-one; providing the player an opportunity to place a poker wager that a two-card poker hand value of an initial two cards dealt to the player will equal one of a plurality of paying two-card poker hand values; dealing the initial two cards to the player; verifying that the player placed the poker wager and paying the player a poker winning amount on the poker wager if the two-card poker hand value of the initial two cards dealt to the player equals one of the plurality of paying two-card poker hand values; and continuing with play of the conventional game of Twenty-one.

In accordance with a more detailed aspect of the present invention, a method for enhancing a conventional game of Twenty-one is provided, and can include the steps of: a player placing a Twenty-one wager to participate in the conventional game of Twenty-one; the player placing a match wager that an index value of at least one of an initial two cards dealt to the player will match an index value of a face-up card dealt to a dealer; the player being dealt the initial two cards; the player winning a match winning amount on the match wager if the index value of at least one of the initial two cards dealt to the player matches the index value of the face-up card dealt to the dealer; the player continuing with play of the conventional game of Twenty-one.

In accordance with a more detailed aspect of the present invention, a method for enhancing a conventional game of Twenty-one is provided and can include the steps of: a player placing a Twenty-one wager to participate in the conventional game of Twenty-one; the player placing a poker wager that a two-card poker hand value of an initial two cards dealt to the player will equal one of a plurality of paying two-card poker hand values; the player being dealt the initial two cards; the player winning a poker winning amount on the poker wager if the two-card poker hand value of the initial two cards dealt to the player equals one of the plurality of paying two-card poker hand values; and the player continuing with play of the conventional game of Twenty-one.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

FIG. 2A is a table of exemplary payouts for match winning amounts in accordance with one aspect of the invention;

FIG. 2B is a table of exemplary payouts for 2-hand poker winning amounts in accordance with one aspect of the invention;

DETAILED DESCRIPTION

Figure 1:
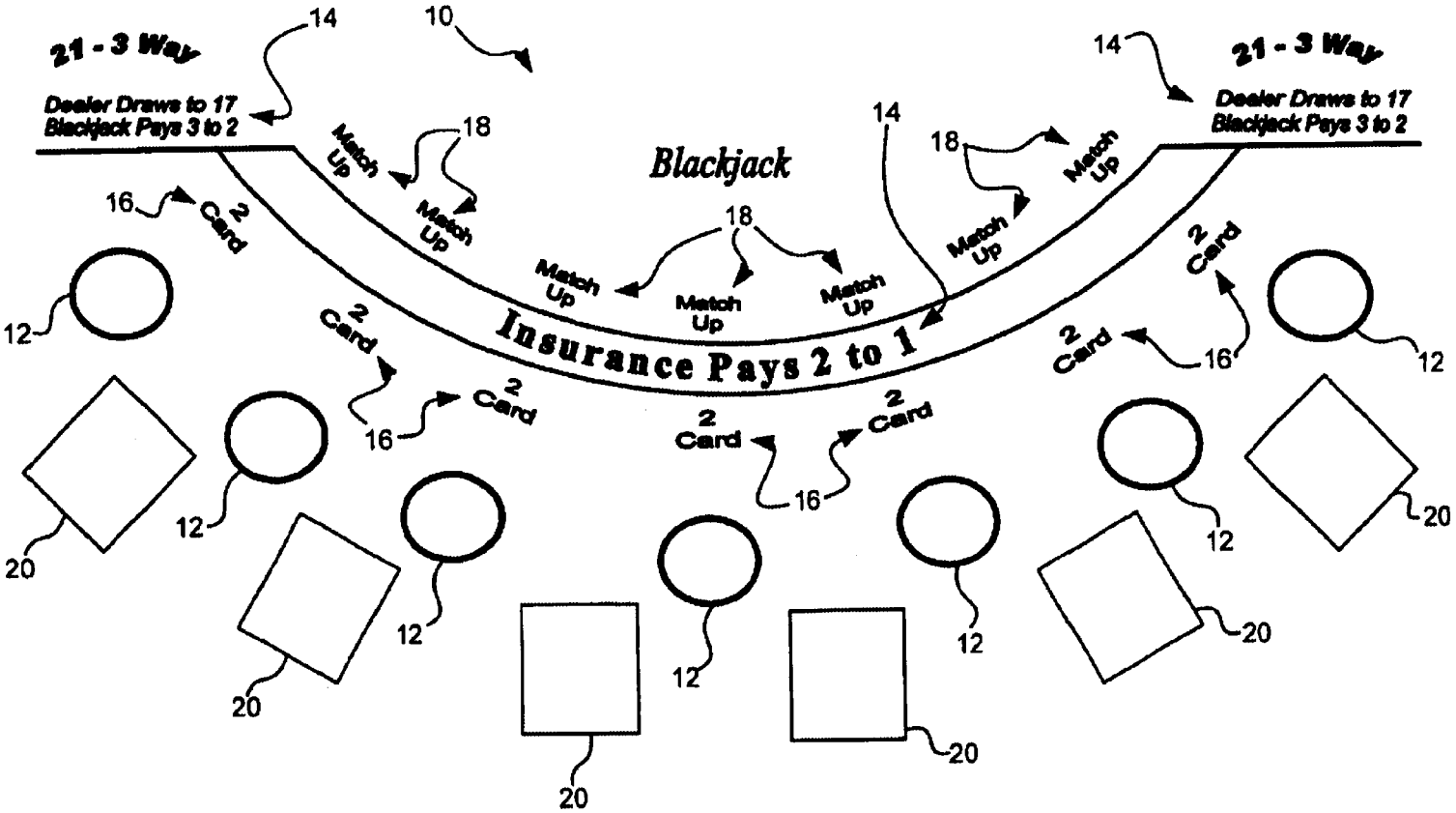
FIG. 1 is a schematic view of an exemplary table layout that can be used in one embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, table layout, indicated generally at 10, in accordance with the present invention is shown for playing an enhanced game of conventional Twenty-one. The table layout can include substantially all of the material presented on or by a conventional Twenty-one table, such as a Twenty-one wager placement area 12 and summaries 14 of the various rules and payouts associated with the conventional game of Twenty-one. In addition to these conventional fields, a table layout according the present invention can include one or more side wager placement areas 16, 18, on which players can place wagers associated with various aspects of the invention. As will be explained in further detail below, at least two side wagers are provided by the invention, including a match-up side wager and a 2-hand poker side wager.

Players or gamblers can play these side wagers by placing an appropriate wager amount in one or both side wager placement areas 16 and/or 18. For example, if a player wishes to play both the match and 2-card poker side wagers, he or she would place a wager in each of the Twenty-one placement areas 12, the match-up placement area 18, and the 2-card placement area 16. As described in more detail below, resolution of each of the Twenty-one wager and side wagers is determined by the cards dealt to both the player and the dealer, who is typically located behind the blackjack table and facing each of the players. In addition to the wager placement areas 16, 18, a payout schedule (shown in more detail in FIGS. 2A and 2B) and/or rules summary 20 can be printed or placed near the wager placement areas to assist players in remembering or understanding the rules and payouts associated with each of the side wagers.

The present invention is generally presented by gaming establishments to enhance a conventional game of Twenty-one. As is known in the art, the conventional game of Twenty-one can be played on the surface of a table physically disposed within a gaming institution, such as a casino. Most often, a live dealer shuffles, deals and collects the cards throughout play. In addition, it is also well known to provide a Twenty-one gaming format via the use of computers and/or stand alone machines, similar to slot machines but with a display component and computer interface to simulate a "real-time" game of blackjack. Also, computers, such as home computers, have been widely used to present Twenty-one gaming over such networks, including the Internet.

As with these various manners of presenting conventional Twenty-one gaming, the present invention, while suited for table play within a casino, can be readily adapted for use in slot-machine type systems, and over network and Internet applications. While such an embodiment associated with the present invention may incorporate a "virtual" table layout similar to that illustrated in FIG. 1, the present invention is not so limited. A variety of table layouts and/or computer display presentations can be utilized to present the methods of the present invention. Also, as in conventional Twenty-one games, the present invention can be played with one or multiple decks of cards. For example, anywhere from two to eight, or more, conventional decks of 52 playing cards can be combined into a "master" playing deck from which the cards are dealt to the player or players and dealer. For this reason, it is possible in the present invention for two or more players and the dealer to be dealt identical cards, i.e., both a player and a dealer can be dealt the ace of spades.

By offering the side wagers discussed in more detail below, the present invention can offer higher and more attractive payout odds that those offered on the Twenty-one wager. Players will find this advantageous, as will the gaming establishment, or "house," as the house advantage on the side wagers can be higher than for general Twenty-one play. Also, the present invention is less volatile than many games such as Let-it-Ride, Caribbean Stud and Super Seven Jackpot, as those games typically pay high payouts at more infrequent intervals (i.e., they include a low "hit frequency"). In contrast, the hit frequency of the present invention is relatively high, resulting in a more constant player excitement level. The high hit frequency of the present invention is also advantageous to the house, as players are more likely to play back his or her winnings when the winnings are delivered at lower levels and more frequently. In contrast, previous games with high payoffs at low frequency often result in players taking the high payoffs when winning and retiring from the game.

Turning now to discussion of the side wagers presented by the invention, in one embodiment of the invention a "match" side wager is presented. In this aspect, the player or players must place an ante to participate in the Twenty-one game, and can also place a match wager to participate in the match game. After the player has wagered on both the Twenty-one and the match game, play begins with a conventional Twenty-one deal, wherein the player is dealt two initial cards, either "face-down" or "face-up," that is, the face or value insignia of the two cards is either concealed (face-down) or visible (face-up). The dealer is also dealt two cards, one of which is face-up, i.e., visible and known to the players.

Prior to continuing with the conventional Twenty-one game, the dealer resolves all wagers associated with the match game. If the index value of one of the player's initial two cards matches the index value of the dealer's face-up, or "up" card, the player wins the match wager and is paid a match winning amount on the match wager. If neither of the player's initial two cards match the index value of the dealer's up card, the player loses the match wager to the casino. As used herein, the term "index value" of a card is to be understood to include the actual face value of the card, and not merely the count value of the card. Thus, in contrast to conventional Twenty-one rules, where a 10, jack, queen and king card each have a count value of "10," the index value in the present invention can be matched exactly. Thus, if the dealer's up card is a jack, a player can have a jack to match the up card and win the match wager. Similarly, a five can be matched with a five, and a king can be matched with a king, etc.

In addition to winning the match wager by being dealt one card which matches the dealer's up card, a player can win by having both cards match the index value of the dealer's up card. The player can also win by having one or more cards that not only match the index value of the dealer's up card but are of a suit that matches the suit of the dealer's up card. As is known in the art, the card deck used with the game of Twenty-one generally includes cards of four suits—hearts, diamonds, spades and clubs. As the probability of a player being dealt a card that matches the index value of the dealer's card and also matches the suit of the dealer's card are lower than the probability of merely matching the index value of the dealer's up card, the payout for a suit and index match can be higher than for a match alone. Similarly, as the probability of the player being dealt two cards of the same index value that also match the index value of the dealer's up card are lower, the payout for a "double" match can also be made higher than for a single index and suit match.

The winning amount paid to a matching player, or the "match winning amount," can thus be varied to the extent a gaming establishment wishes to vary the odds of the match game. In one aspect of the invention, the match winning amount is a multiple of the player's wager, i.e., the player is played 2:1, 2.5:1, 10:1, etc. The payoff multiple can vary in magnitude depending on an outcome of the wager. For example, if the index value of only one of the initial two cards dealt to the player matches the index value of the face-up card (one card match, unsuited), the multiple can be of a lower magnitude. If the index value of one of the initial two cards dealt to the player matches the index value of the face-up card and the suit of the initial card dealt to the player with the index value matching the face-up card matches the suit of the face-up card (one card match, suited), the multiple can be of an intermediate magnitude. Similarly, if the index value of both of the initial two cards dealt to the player is the same and both match the index value of the face-up card (two matches, any suit), the multiple can be of a higher magnitude.

In addition, as shown by example in FIG. 2A, a payout schedule 20*a* can be utilized with the present invention. As will be appreciated, in this aspect utilizing six decks of cards, the player wins a return on his match wager of 4:1 when one of his or her cards matches the index value of the dealer's up card. The player wins a return of 10:1 when his or her card matches the index value and the suit of the dealer's up card. The player wins a return of 15:1 when his or her initial two cards are the same index value and match the index value of the dealer's up card. A similar payout schedule is shown for a game using only two decks, where the probability of drawing the match hands decreases, and can result in a higher payoff for a double match.

It is to be understood that the payout schedules given by example in FIGS. 2A and 2B (20*a* and 20*b*, respectively) are provided only as examples of payouts that can be utilized in the present invention. The payout schedule can be altered by a gaming establishment for various considerations, including popularity of the side wagers, number of decks in play, to vary the house edge, etc. Similarly, the payout ratios need not correspond with those presented, for example, the payout for a one card suited match may be twice that of the payout for a one card unsuited match, rather than 2.5, as shown. Also, in addition to those hands indicated herein as winning hands, other hands may be established as winning hands. For example, premium or bonus payouts may be offered for ace-value cards in a match or poker hand. Also, match hands may pay a premium or bonus for two matching index cards that also match the suit of the dealer's up card, or two matching index value cards with only one matching the suit of the dealer's up card, etc.

In accordance with another aspect of the present invention, a 2-card poker side wager can be offered. In this aspect, after placement of wagers, the player's and dealer's cards are dealt as described above. For purposes of the 2-card side wager, the player's initial two cards are combined into a 2-card poker hand. As used herein, the term "2-card poker hand" is to be understood to refer to a conventional poker ranking system but applied to two cards only. For example, a 2-card poker hand with cards of the same index value is a pair. Two cards with the same suit are a flush; two cards in immediate consecutive numeric value are a straight, i.e., 9–10 or Queen–King, etc. Two cards with the same suit and in immediate consecutive order are a straight flush, i.e., 9–10 of diamonds, Queen–King of spades, etc.

In this aspect of the invention, a plurality of winning 2-card poker hands can be established by the gaming establishment, or "house." In one aspect of the invention, the winning 2-card poker hands are one of: a pair, a straight, and a straight flush. The winning 2-card poker hands can be defined as including other hands, for example, a 2-card flush, a 2-card perfect match (same index value and suit), etc. If a player is dealt a winning 2-card poker hand, he or she can be paid a winning 2-card poker amount which can be, for example, established by the schedule 20*b* illustrated in FIG. 2B. In one aspect of the invention, the winning poker amount can be a multiple of the player's 2-card poker wager, and the multiple can have a first, lower magnitude if the 2-card poker hand is a pair or a straight, and can have a higher magnitude if the 2-card poker hand is a straight flush, as shown by example in FIG. 2B.

While the match and 2-card poker side wagers are described individually above, it is contemplated that many players will play either or both of the side wagers in addition to his or her Twenty-one wager. In this aspect, the player's initial two cards will serve as both his or her match cards and his or her 2-hand poker cards. In this manner, players are provided with a heightened excitement level, as the players are provided with three chances of winning a wager. The house advantageously is also benefited when players play both side wagers, as the house "edge" is generally increased with each wager placed by a player. While not so limited, in one aspect of the present invention, after dealing the cards to all players and the dealer, the dealer acts on, or settles, all match wagers first, then all 2-card poker wagers, after which he or she continues with conventional Twenty-one play.

Figure 3:
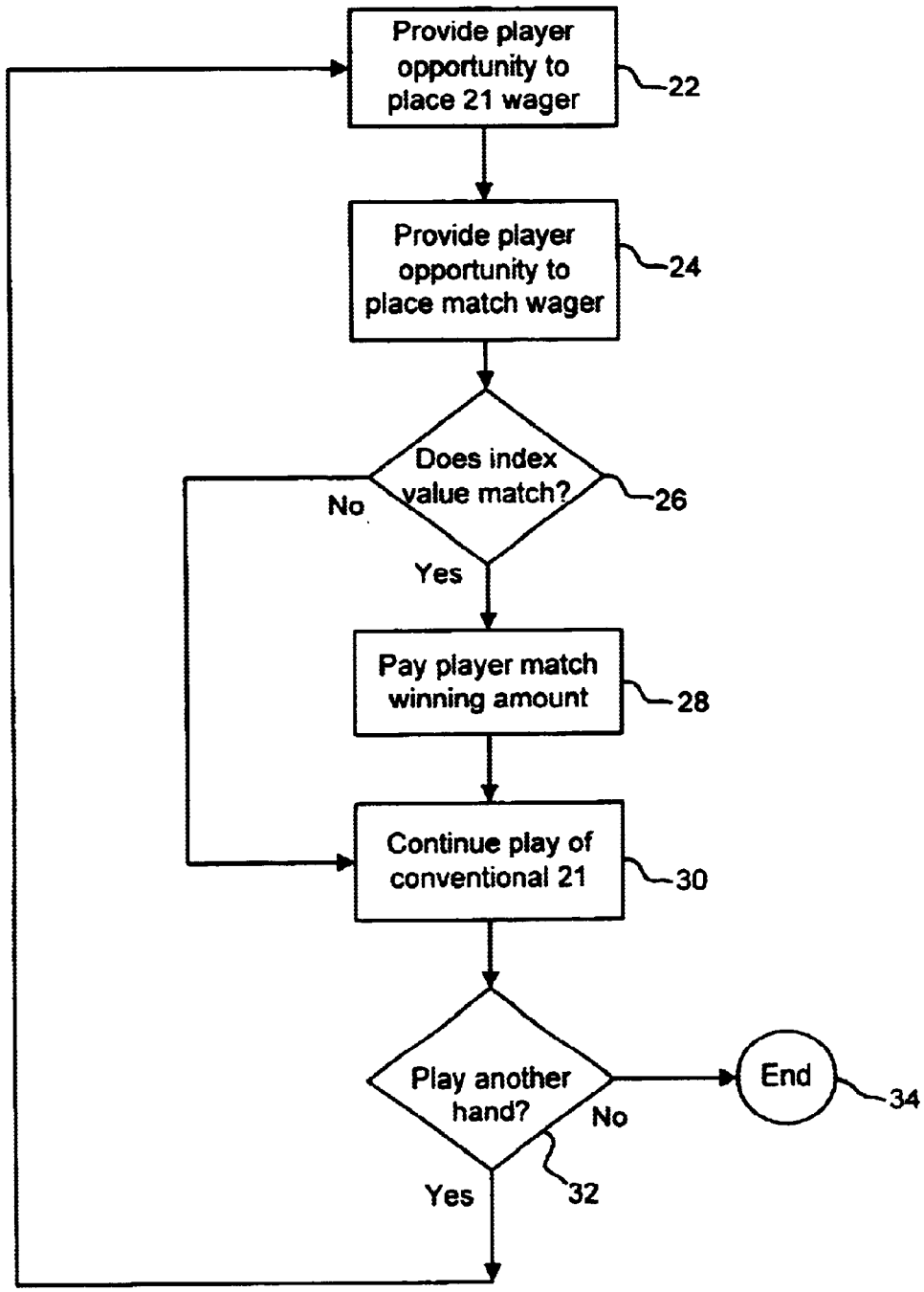
FIG. 3 is a flowchart illustrating steps of one example of a method of enhancing a conventional Twenty-one game in accordance with an embodiment of the present invention.

FIGS. 3 through 6 illustrate in flowchart form examples of steps that can be incorporated into the present invention. As shown in FIG. 3, the present method can begin with the step 22 of providing a player an opportunity to place a Twenty-one wager to participate in the conventional game of Twenty-one. At step 24, the player is provide with the opportunity to place a match wager that an index value of at least one of an initial two cards dealt to the player will match an index value of a face-up card dealt to the dealer. After step 24 the initial two cards can be dealt to the player and a face-up card can be dealt to the dealer.

After the initial cards have been dealt, the method can continue with step 26 by verifying that at least one of the initial two cards dealt to the player matches the index value of the face-up card. If the player was dealt a match, he or she is paid at step 28. If the player was not dealt a match, the method skips step 28 and proceeds instead to step 30, where play of the conventional Twenty-one game is continued. After play for the hand has been completed, the player can either play another hand by proceeding again to step 22, or can end at 34.

Figure 4:
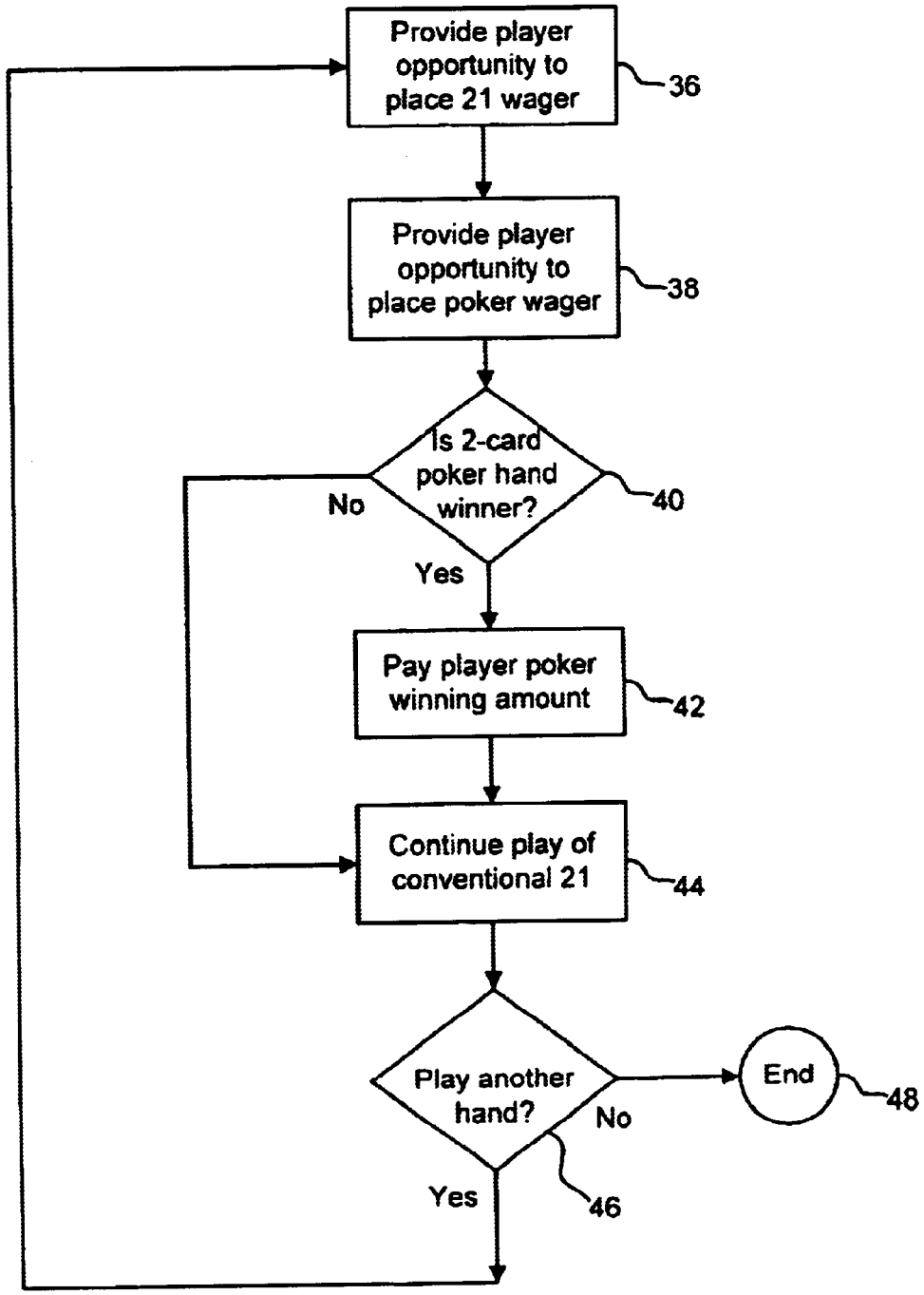
FIG. 4 is a flowchart illustrating steps of another example of a method of enhancing a conventional Twenty-one game in accordance with an embodiment of the present invention.

Another aspect of the invention is illustrated in FIG. 4, which begins with the step 36 of providing a player an opportunity to place a Twenty-one wager to participate in the conventional game of Twenty-one. At step 38 the player is provided with an opportunity to place a poker wager that a two-card poker hand value of an initial two cards dealt to the player will equal one of a plurality of paying two-card poker hand values. After step 38, two initial cards are dealt to the player, and a face-up card can be dealt to the dealer at this time.

After the deal, the method continues with step 40, where it is verified that the player was dealt a winning 2-card poker hand. If the player has a winning 2-card hand, the method proceeds to step 42 where the player is paid a poker winning amount. If the player was not dealt a winning 2-card hand, the method skips step 42 and proceeds to step 44, where conventional Twenty-one play is resumed. After completion of conventional Twenty-one play, the player, at step 46, can play another hand or end at 48.

Figure 5:
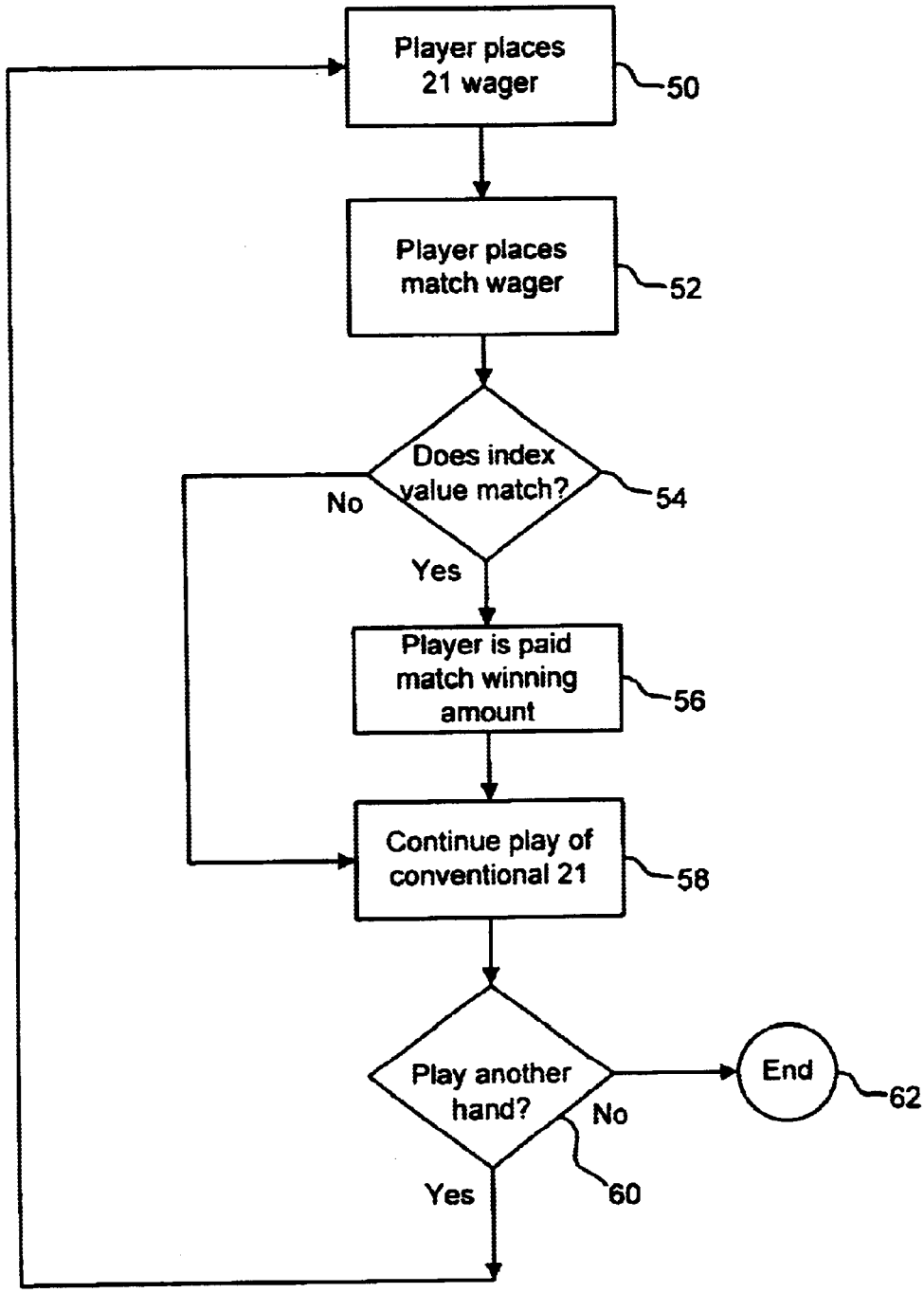
FIG. 5 is a flowchart illustrating steps of another example of a method of enhancing a conventional Twenty-one game in accordance with an embodiment of the present invention.

Another aspect of the invention is illustrated in FIG. 5, which begins with the step 50 of a player placing a Twenty-one wager to participate in the conventional game of Twenty-one. At step 52, the player places a match wager that an index value of at least one of an initial two cards dealt to the player will match an index value of a face-up card dealt to a dealer. After step 52, two initial cards are dealt to the player and a face-up card (at least) can be dealt to the dealer. At step 54 it is determined if the player was dealt a winning match hand. If so, the player is paid a winning match amount at 56. If no match was dealt the player, the method skips to step 58 where conventional Twenty-one play is continued. At step 60 the player can opt to play another hand at 50 or end at 62.

Figure 6:
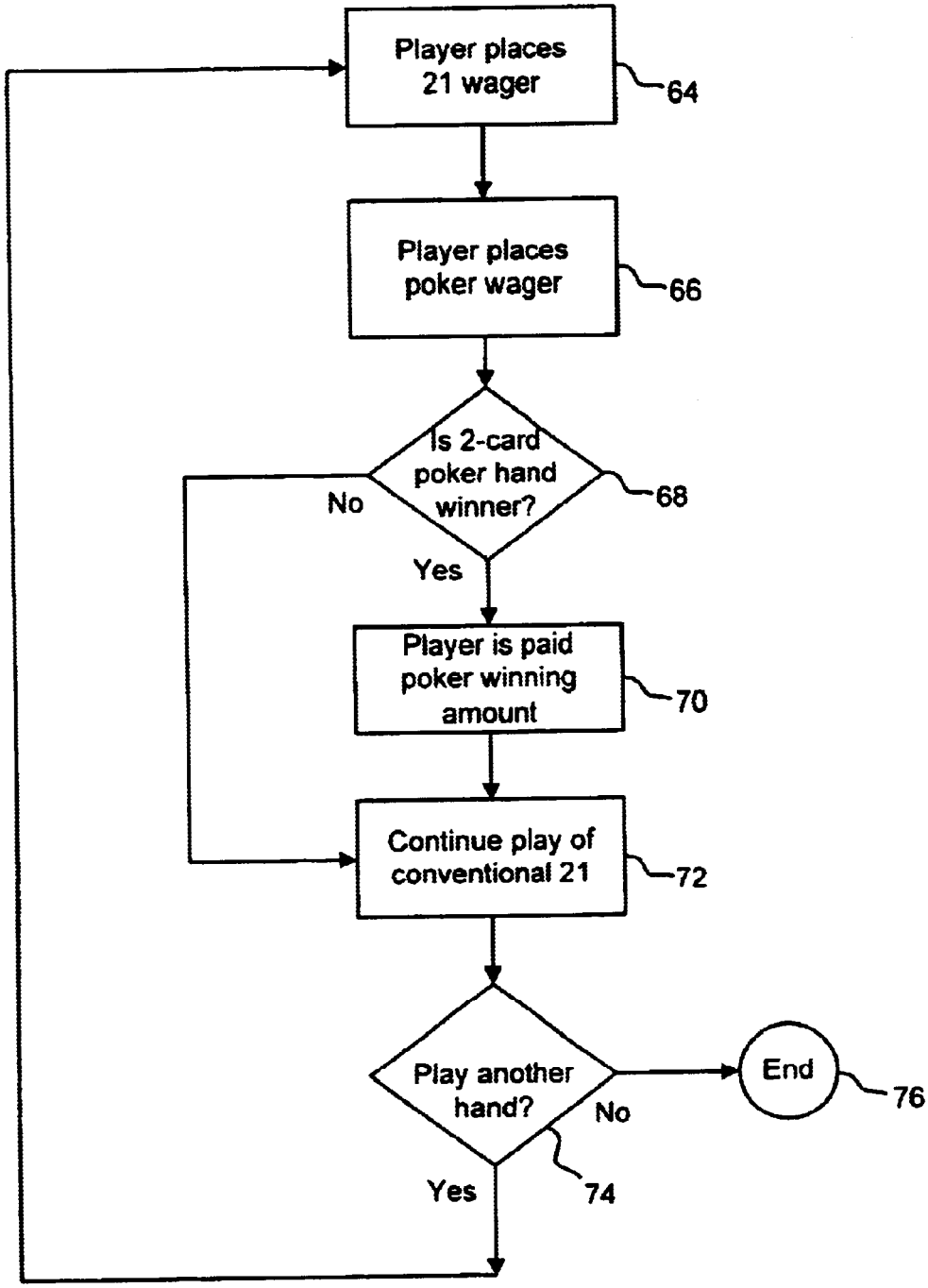
FIG. 6 is a flowchart illustrating steps of another example of a method of enhancing a conventional Twenty-one game in accordance with an embodiment of the present invention.

Another aspect of the invention is illustrated in flowchart form in FIG. 6. In this embodiment, the method begins with step 64 with a player placing a Twenty-one wager to participate in the conventional game of Twenty-one. At step 66 the player places a poker wager that a two-card poker hand value of an initial two cards dealt to the player will equal one of a plurality of paying two-card poker hand values. After step 66, two initial cards are dealt to the player and one face-up card can be dealt to the dealer. At step 68 it is determined if the two-card poker hand value of the initial two cards dealt to the player equals one of the plurality of paying two-card poker hand values. If so, the player is paid a winning poker amount at step 70. If not, the player continues with play of the conventional game of Twenty-one at step 72. At step 74 the player can opt to return to step 64 to play another hand or end at 76.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A method for enhancing a conventional game of Twenty-one, comprising the steps of:

providing a player an opportunity to place a Twenty-one wager to participate in the conventional game of Twenty-one;

providing the player an opportunity to place a match wager that an index value of at least one of an initial two cards dealt to the player will match an index value of a face-up card dealt to a dealer;

dealing the initial two cards to the player;

verifying that the player placed the match wager and paying the player a match winning amount on the match wager if the index value of at least one of the initial two cards dealt to the player matches the index value of the face-up card; and continuing with play of the conventional game of Twenty-one.

2. The method of claim 1, wherein the match winning amount is a multiple of the match wager, and wherein:

the multiple is of a lower magnitude if the index value of only one of the initial two cards dealt to the player matches the index value of the face-up card;

the multiple is of an intermediate magnitude if the index value of one of the initial two cards dealt to the player matches the index value of the face-up card and a suit of the initial card dealt to the player with the index value matching the face-up card matches a suit of the face-up card; and the multiple is of a higher magnitude if the index value of both of the initial two cards dealt to the player is the same and both match the index value of the face-up card.

3. The method of claim 1, comprising the further steps of:

providing the player an opportunity to place a poker wager that a two-card poker hand value of the initial two cards dealt to the player will equal one of a plurality of paying two-card poker hand values; and verifying that the player placed the poker wager and paying the player a poker winning amount if the two-card poker hand value of the initial two cards dealt to the player equals one of the plurality of paying two-card poker hand values.

4. The method of claim 3, wherein the plurality of paying two-card poker hand values includes one of the values selected from the group consisting of: a pair; a two-card straight; and a two-card straight flush.

5. The method of claim 4, wherein the poker winning amount is a multiple of the poker wager, and wherein:

the multiple is of a lower magnitude if the two-card poker hand value is one of: a two-card straight; or a pair; and the multiple is of a higher magnitude if the two-card poker hand value is a two-card straight flush.

6. A method for enhancing a conventional game of Twenty-one, comprising the steps of:

providing a player an opportunity to place a Twenty-one wager to participate in the conventional game of Twenty-one;

providing the player an opportunity to place a poker wager that a two-card poker hand value of an initial two cards dealt to the player will equal one of a plurality of paying two-card poker hand values;

dealing the initial two cards to the player;

verifying that the player placed the poker wager and paying the player a poker winning amount on the poker wager if the two-card poker hand value of the initial two cards dealt to the player equals one of the plurality of paying two-card poker hand values; and continuing with play of the conventional game of Twenty-one.

7. The method of claim 6, wherein the plurality of paying two-card poker hand values includes one of the values selected from the group consisting of: a pair; a two-card straight; and a two-card straight flush.

8. The method of claim 7, wherein the poker winning amount is a multiple of the poker wager, and wherein:

the multiple is of a lower magnitude if the two-card poker hand value is one of: a two-card straight; or a pair; and the multiple is of a higher magnitude if the two-card poker hand value is a two-card straight flush.

9. The method of claim 6, comprising the further steps of:

dealing a face-up card to a dealer;

providing the player an opportunity to place a match wager that an index value of at least one of the initial two cards dealt to the player will match an index value of the face-up card; and verifying that the player placed the match wager and paying the player a match winning amount on the match wager if the index value of at least one of the initial two cards dealt to the player matches the index value of the face-up card.

10. The method of claim 9, wherein the match winning amount is a multiple of the match wager, and wherein:

the multiple is of a lower magnitude if the index value of only one of the initial two cards dealt to the player matches the index value of the face-up card;

the multiple is of an intermediate magnitude if the index value of one of the initial two cards dealt to the player matches the index value of the face-up card and a suit of the card dealt to the player with the index value matching the face-up card matches a suit of the face-up card; and the multiple is of a higher magnitude if the index value of both of the initial two cards dealt to the player is the same and both match the index value of the face-up card.

11. A method for enhancing a conventional game of Twenty-one, comprising the steps of:

a player placing a Twenty-one wager to participate in the conventional game of Twenty-one;

the player placing a match wager that an index value of at least one of an initial two cards dealt to the player will match an index value of a face-up card dealt to a dealer;

the player being dealt the initial two cards;

the player winning a match winning amount on the match wager if the index value of at least one of the initial two cards dealt to the player matches the index value of a face-up card dealt to the dealer;

the player continuing with play of the conventional game of Twenty-one.

12. The method of claim 11, wherein the match winning amount is a multiple of the match wager, and wherein:

the multiple is of a lower magnitude if the index value of only one of the initial two cards dealt to the player matches the index value of the face-up card;

the multiple is of an intermediate magnitude if the index value of one of the initial two cards dealt to the player matches the index value of the face-up card and a suit of the card dealt to the player with the index value matching the face-up card matches a suit of the face-up card; and the multiple is of a higher magnitude if the index value of both of the initial two cards dealt to the player is the same and both match the index value of the face-up card.

13. The method of claim 11, comprising the further steps of:

the player placing a poker wager that a two-card poker hand value of the initial two cards dealt to the player will equal one of a plurality of paying two-card poker hand values; and the player winning a poker winning amount if the two-card poker hand value of the initial two cards dealt to the player equals one of the plurality of paying two-card poker hand values.

14. The method of claim 13, wherein the plurality of paying two-card poker hand values includes one of the values selected from the group consisting of: a pair; a two-card straight; and a two-card straight flush.

15. The method of claim 14, wherein the poker winning amount is a multiple of the poker wager, and wherein:

the multiple is of a lower magnitude if the two-card poker hand value is one of: a two-card straight; or a pair; and the multiple is of a higher magnitude if the two-card poker hand value is a two-card straight flush.

16. A method for enhancing a conventional game of Twenty-one, comprising the steps of:

a player placing a Twenty-one wager to participate in the conventional game of Twenty-one;

the player placing a poker wager that a two-card poker hand value of an initial two cards dealt to the player will equal one of a plurality of paying two-card poker hand values;

the player being dealt the initial two cards;

the player winning a poker winning amount on the poker wager if the two-card poker hand value of the initial two cards dealt to the player equals one of the plurality of paying two-card poker hand values; and the player continuing with play of the conventional game of Twenty-one.

17. The method of claim 16, wherein the plurality of paying two-card poker hand values includes one of the values selected from the group consisting of: a pair; a two-card straight; and a two-card straight flush.

18. The method of claim 17, wherein the poker winning amount is a multiple of the poker wager, and wherein:

the multiple is of a lower magnitude if the two-card poker hand value is one of: a two-card straight; or a pair; and the multiple is of a higher magnitude if the two-card poker hand value is a two-card straight flush.

19. The method of claim 16, comprising the further steps of:

a face-up card being dealt to a dealer;

the player placing a match wager that an index value of at least one of the initial two cards dealt to the player will match an index value of the face-up card dealt to the dealer; and the player winning a match winning amount on the match wager if the index value of at least one of the initial two cards dealt to the player matches the index value of the face-up card.

20. The method of claim 19, wherein the match winning amount is a multiple of the match wager, and wherein:

the multiple is of a lower magnitude if the index value of only one of the initial two cards dealt to the player matches the index value of the face-up card;

the multiple is of an intermediate magnitude if the index value of one of the initial two cards dealt to the player matches the index value of the face-up card and a suit of the card dealt to the player with the index value matching the face-up card matches a suit of the face-up card; and the multiple is of a higher magnitude if the index value of both of the initial two cards dealt to the player is the same and both match the index value of the face-up card.

* * * * *